US009909592B2

(12) United States Patent
Hofmann et al.

(10) Patent No.: US 9,909,592 B2
(45) Date of Patent: Mar. 6, 2018

(54) VACUUM PUMP

(71) Applicant: Pfeiffer Vacuum GmbH, Asslar (DE)

(72) Inventors: Jan Hofmann, Gruenberg (DE); Mirko Mekota, Ehringshausen (DE)

(73) Assignee: PFEIFFER VACUUM GMBH, Asslar (DE)

( * ) Notice: Subject to any disclaimer, the term of this patent is extended or adjusted under 35 U.S.C. 154(b) by 663 days.

(21) Appl. No.: 14/328,766

(22) Filed: Jul. 11, 2014

(65) Prior Publication Data

US 2015/0016958 A1 Jan. 15, 2015

(30) Foreign Application Priority Data

Jul. 15, 2013 (DE) ..... 10 2013 213 815

(51) Int. Cl.

| | |
|---|---|
| ***F04D 19/04*** | (2006.01) |
| ***F04D 29/056*** | (2006.01) |
| ***F04D 29/64*** | (2006.01) |
| ***F04D 29/10*** | (2006.01) |

(52) U.S. Cl.

CPC ..... *F04D 29/056* (2013.01); *F04D 19/04* (2013.01); *F04D 19/042* (2013.01); *F04D 29/102* (2013.01); *F04D 29/646* (2013.01); *Y10T 29/49245* (2015.01)

(58) Field of Classification Search

CPC ..... F04D 29/056; F04D 19/04; F04D 19/042; F04D 29/102; F04D 29/646; Y10T 29/49245

See application file for complete search history.

(56) References Cited

U.S. PATENT DOCUMENTS

| | | | | |
|---|---|---|---|---|
| 4,512,725 | A | 4/1985 | Saulgeot | |
| 5,688,106 | A | 11/1997 | Cerruti et al. | |
| 5,695,316 | A * | 12/1997 | Schutz | F04D 17/168 415/143 |
| 6,705,844 | B2 * | 3/2004 | Englander | F04D 29/083 277/400 |
| 7,717,784 | B2 | 5/2010 | Sekiguchi | |
| 8,066,495 | B2 * | 11/2011 | Sekiguchi | F04D 19/04 417/324 |
| 8,123,412 | B2 | 2/2012 | Koci | |
| 2006/0263205 | A1 | 11/2006 | Kawasaki et al. | |
| 2013/0045094 | A1 * | 2/2013 | Giors | F04D 19/042 415/200 |

FOREIGN PATENT DOCUMENTS

| | | | |
|---|---|---|---|
| DE | 101 49 366 | A1 | 4/2003 |
| JP | 2009-203906 | A | 9/2009 |
| JP | 2010-236530 | A | 10/2010 |

* cited by examiner

*Primary Examiner* — Kenneth Bomberg
*Assistant Examiner* — Brian Delrue
(74) *Attorney, Agent, or Firm* — Abelman, Frayne & Schwab

(57) ABSTRACT

A vacuum pump has a working space, a bearing space, a dividing wall arranged between the working space and the bearing space and at least one rotor shaft which extends through the dividing wall and which forms a gap with the dividing wall and having a blocking device for blocking between the working space and the bearing space. The blocking device is formed by a Siegbahn pump stage which is configured for providing a pump action passing through the gap between the working space and the bearing space.

12 Claims, 4 Drawing Sheets

VACUUM PUMP

BACKGROUND OF THE INVENTION

1. Field of the Invention

The invention relates to a vacuum pump, in particular to a turbomolecular pump or a side channel pump, having a working space, a bearing space, a dividing wall arranged between the working space and the bearing space and a rotor shaft extending through the dividing wall.

2. Description of the Prior Art

Vacuum pumps are used in different technical processes to provide a vacuum required for the respective process. A vacuum pump typically comprises a working space, a bearing space, a dividing wall arranged between the working space and the bearing space and a rotor shaft. A pump structure of the vacuum pump is arranged in the working space, the pump structure conveying the process gas present in the working space from the inlet to the outlet of the vacuum pump and thereby pumping said process gas. A bearing for supporting the rotor shaft and, optionally, a drive for the rotor shaft are e.g. arranged in the bearing space. The rotor shaft extends through the dividing wall while forming a gap. In this respect, a section of the rotor shaft which carries the part of the pump structure at the rotor side extends into the working space and another section of the rotor shaft which is e.g. connected to the bearing extends into the bearing space.

A problem with known vacuum pumps is represented by corrosive gases and other damaging gases which are contained in the conveyed process gas and move through the gap formed between the rotor shaft and the dividing wall from the working space into the bearing space. These gases attack the bearings, operating media and further components present in the bearing space, which can result in damage and in a premature failure of the pump.

To block the bearing space from the working space, i.e. to prevent an unwanted gas exchange between the working space and the bearing space, a labyrinth seal can be provided between the rotor shaft and the dividing wall. The labyrinth seal can comprise a plurality of axial recesses of a rotor disk which follow one another in the radial direction and which mesh with corresponding projections of the surrounding dividing wall so that a long and narrow gap is formed between the rotor shaft and the dividing wall which effects a sealing. In principle, the labyrinth seal can also comprise a plurality of radial recesses of the rotor shaft which follow one another in the axial direction and which form a long and narrow sealing gap with the dividing wall.

A disadvantage of a vacuum pump having such a labyrinth seal is that very narrow gaps are required for a high sealing effect and said narrow gaps can only be achieved with difficulty due to the thermal expansions which occur in the operation of the vacuum pump and due to the expansions based on the centrifugal forces which occur at high rotational speeds. In addition, the provision of a vacuum pump having such a labyrinth seal is associated with a high additional manufacturing effort. The recesses in the rotor disk can furthermore result in the occurrence of unfavorable mechanical strains in the rotor during the pump operation which impair the service life and the operating safety of the vacuum pump. The labyrinth seal additionally produces a substantial increase in the axial construction height and in the power requirement of the vacuum pump due to the gas friction which occurs in the narrow gaps.

It is therefore an object of the invention to provide a vacuum pump which overcomes the above-described disadvantages, that is a vacuum pump in which a damaging exchange of gas between the working space and the bearing space is avoided, the vacuum pump at the same time being able to be manufactured with a small effort, being able to be realized in a small construction space and having a small power requirement and a high service life.

SUMMARY OF THE INVENTION

The object is satisfied by a vacuum pump which is preferably a turbomolecular pump or a side-channel pump and comprises a working space, a bearing space, a dividing wall arranged between the working space and the bearing space and at least one rotor shaft which extends through the dividing wall and which forms a gap with the dividing wall. The vacuum pump additionally comprises a blocking device for blocking between the working space and the bearing space. The blocking device is formed by a Siegbahn pump stage which is configured for providing a pump action passing through the gap between the working space and the bearing space.

It has been recognized that an effective blocking between the working space and the pump space is achieved by such a Siegbahn pump stage without the manufacturing effort, the axial construction height or the power requirements of the vacuum pump being increased or the stability and the service life of the vacuum pump being reduced.

The Siegbahn pump stage provides an effective blocking between the working space and the bearing space since a gas flow through the gap directed against the pump direction of the Siegbahn pump stage is effectively prevented by the pump action of the Siegbahn pump stage. The use of a barrier gas can optionally be dispensed with in this respect. The use of a barrier gas is, however, also conceivable in principle. The operation of the Siegbahn pump stage additionally does not result in a substantial increase in the power requirement of the vacuum pump.

The provision of the Siegbahn pump stage is possible with simple means. For example, the Siegbahn pump stage can comprise a disk-shaped stator member oriented in the radial direction and a disk-shaped rotor member oriented in the radial direction, said stator and rotor members forming mutually oppositely disposed surfaces acting as pumps, with one of the surfaces acting as a pump being smooth or planar and the other being structured. Such stator and rotor members can be manufactured simply and a complex machining of the rotor disk and of the oppositely arranged stator partner for the establishing of a plurality of axial recesses and a weakening of the rotor disk associated therewith can be avoided.

The axial construction height is at most slightly increased due to the radial alignment of the Siegbahn pump stage. The Siegbahn pump stage can have an axial sealing gap, with a small gap width of the sealing gap being able to be achieved with a small effort despite the thermal expansions of the vacuum pump.

Advantageous embodiments of the invention are described in the dependent claims, in the description and in the Figures.

The Siegbahn pump stage is preferably configured to provide a pump action from the bearing space via the gap into the working space. The bearing space is thereby effectively blocked with respect to the working space so that no damaging process gases can move from the working space into the bearing space.

The Siegbahn pump stage preferably comprises a stator member and a rotor member. The stator member and the rotor member preferably each form one of two mutually oppositely disposed surfaces acting as pumps of the Siegbahn pump stage. The stator member is preferably carried and thereby formed by a static part of the vacuum pump, for example the pump housing or the dividing wall. The rotor member is preferably carried by the rotor shaft and is in particular rotationally fixedly attached to the rotor shaft.

At least one surface acting as a pump of the Siegbahn pump stage is preferably formed by a structured surface and/or at least one surface acting as a pump is formed by a planar surface. In accordance with an embodiment, one surface acting as a pump is formed by a structured surface and the other surface acting as a pump is formed by a planar surface.

The stator member preferably has the structured surface acting as a pump. The rotor member can, in contrast, have the planar surface acting as a pump. The rotor member can be manufactured with a particularly small effort in this case, with simultaneously a disadvantageous weakening of the rotor member resulting from a structuring being avoided.

The rotor member is in this respect easily capable of withstanding the centrifugal force strains which occur in the operation of the vacuum pump without excessive strains occurring which reduce the operating safety of the vacuum pump. Furthermore, an imbalance of the rotor caused by the rotor member due to a planar or smooth design of the surface acting as a pump of the rotor member is very largely avoided.

The rotor member preferably simultaneously forms both the surface acting as a pump for the Siegbahn pump stage and a rotating member for a pump stage for conveying the process gas. The rotor member is preferably formed by a rotating member of the pump stage acting as a pump for the process gas which comprises a surface acting as a pump for the process gas or is formed by a rotor hub of the pump stage for the process gas. For example, the rotor member can be formed by a rotor disk of a turbomolecular pump stage or by a rotor hub of a Holweck pump stage or of a cross-thread pump stage which can e.g. carry a Holweck cylinder.

The surfaces acting as pumps of the Siegbahn pump stage can bound at least a conveying passage of the Siegbahn pump stage and a sealing gap for sealing the conveying passage. In the operation of the vacuum pump, the gas is driven through the conveying passage, with the sealing gap being so narrow that an unwanted backflow, directed against the pump direction, of the gas conveyed through the conveying passage being largely avoided.

A structured surface acting as a pump of the vacuum pump preferably comprises at least one depression which forms the conveying passage and at least one elevated portion, with a surface region of the elevated portion which faces the oppositely disposed surface acting as a pump being able to bound the sealing gap together with the oppositely disposed surface acting as a pump.

The conveying passage can be of spiral shape and/or can substantially extend in a radial plane. The conveying passage preferably connects an inlet and an outlet of the Siegbahn pump stage. One of the inlet or the outlet can be arranged at a radial inner side of the Siegbahn pump stage and the respective pother one of the inlet or the outlet can be arranged at the radial outer side of the Siegbahn pump stage.

The sealing gap can be formed by an axial gap between the surfaces acting as pumps of the Siegbahn pump stage. The Siegbahn pump stage can in principle manage fully without any radial sealing gaps. Since the thermal expansions of the vacuum pump occurring in the axial direction are small in comparison with the radial expansions, a small gap width and a correspondingly good barrier effect can reliably be ensured in this respect.

A region of at least one surface acting as a pump which bounds the sealing gap is or can preferably be produced at least sectionally by a material-removing processing. A desired small gap width of the sealing gap and a correspondingly high barrier effect of the Siegbahn pump stage can be ensured with high reliability and with a small effort thanks to the material-removing processing. The material-removing processing can in particular comprise a cutting or machining process such as turning or grinding.

For example, a blank having a structured surface can first be provided for the manufacture of the member having the structured surface acting as a pump, preferably of the stator member, with subsequently those regions of the structured surface which bound the sealing gap being machined by turning or grinding over the blank to adapt the member to a desired gap width.

The stator member and/or the rotor member is/are preferably substantially disk-shaped. The disk plane of the stator member and/or of the rotor member in this respect preferably extends radial to the axis of rotation of the rotor shaft. The rotor member is preferably rotationally symmetrical. The operating security is thereby increased since an imbalance caused by the rotor member is avoided.

The stator member and/or the rotor member can be configured as an injection molded part as a forged part or as a shaped part. Injection molding, forging or shaping are in particular suitable for manufacturing a member which has a structured surface acting as a pump, e.g. a stator member having a structured surface acting as a pump. A structuring for the structured surface acting as a pump can already be established during the injection molding, forging or shaping. The structuring established during the injection molding, forging or shaping can be final or can be reworked, in particular by the above-described material-removing processes.

In accordance with an embodiment, the stator member and/or the rotor member at least partly or completely comprise(s) a metal such as aluminum. In accordance with a further embodiment, the stator member and/or the rotor member at least partly or completely comprise(s) a plastic. The stator member and/or the rotor member can at least partly or completely comprise a fiber-reinforced plastic such as a glass fiber-reinforced plastic or a carbon fiber-reinforced plastic. These materials ensure an inexpensive manufacturing capability of the stator member and of the rotor member which has a geometric precision desired for a high efficiency of the Siegbahn pump stage. At the same time, the named materials are able to withstand the mechanical and thermal strains which occur in the operation of the vacuum pump.

The stator member can be configured as a separate part which is carried by a static component of the vacuum pump. The stator member can e.g. be carried by a pump housing of the vacuum pump or by the dividing wall. The stator member can be adhesively bonded to the static component of the vacuum pump. In this embodiment, the stator member can be manufactured separately, whereby the effort required for the provision of the vacuum pump is reduced.

The working space and the bearing space are preferably directly adjacent one another and are directly separated from one another by the dividing wall. A rotary bearing for the rotational support of the rotor shaft is preferably arranged in the bearing space; for example, a roller element bearing which is preferably a lubricated roller element bearing. Alternatively or additionally, a drive can be arranged in the bearing space for the rotating drive of the rotor shaft.

The rotary bearing provided in the bearing space is preferably arranged in the vicinity of the blocking device. The influence of the mechanical and thermal loads on the positioning accuracy of the rotor shaft in the region of the Siegbahn pump stage occurring in the operation of the vacuum pump can thereby be limited so that a Siegbahn pump stage having a sealing gap with a particularly small gap width can be realized.

The vacuum pump is preferably a fast-rotating vacuum pump, for example a turbomolecular pump or a side-channel pump. The pump structure of the vacuum pump can be arranged in the working space of the vacuum pump and the process gas to be pumped by the vacuum pump can be conveyed by said pump structure from a pump inlet to a pump outlet of the vacuum pump. The rotating part of this pump structure is preferably carried by the rotor shaft.

The pump structure in a turbomolecular pump preferably comprises one or more stator disks and comprises rotor disks which are arranged between the stator disks and which together realize a turbomolecular pump principle. With a side-channel pump, the pump structure can comprise at least one ring of blades at the rotor side which are arranged in a side channel at the stator side which is widened with respect to the outline shape of the blades viewed in the rotational direction so that a side-channel pump principle is realized.

A barrier gas, which can be conveyed by the Siegbahn pump stage from the bearing space into the working space, can be supplied to the bearing space, in particular via a barrier gas inlet which connects the bearing space in a gas-conductive manner to the pump exterior. The barrier effect provided by the Siegbahn pump stage is thereby optimized.

A further subject of the invention is a method for manufacturing a vacuum pump, in particular a turbomolecular pump or a side-channel pump, in which a working space, a bearing space, a dividing wall arranged between the working space and the bearing space and at least one rotor shaft which extends through the dividing wall and which forms a gap with the dividing wall are provided. Furthermore, a barrier device is provided for blocking between the working space and the bearing space. A Siegbahn pump stage is provided as the blocking device in this respect and is configured for providing a pump action passing through the gap between the working space and the bearing space. The method is suitable for manufacturing a vacuum pump in accordance with the invention in accordance with the present description. The advantageous embodiments and advantages described in the present description with respect to the vacuum pump and to its manufacture represent corresponding advantages and advantageous embodiments of the method.

In accordance with an advantageous embodiment, a stator member and a rotor member are each produced with a respective surface acting as a pump. The surfaces acting as pumps preferably bound at least a conveying passage of the Siegbahn pump stage and a sealing gap for sealing the conveying passage. In accordance with an advantageous embodiment, a region of at least one surface acting as a pump which bounds the sealing gap is produced at least sectionally by a material-removing machining. The sealing gap can thereby be adapted particularly precisely and an especially small gap width of the sealing gap can be ensured which ensures a high efficiency of the Siegbahn pump stage.

In accordance with an embodiment, a stator member for the Siegbahn pump stage is provided as a separate part and is attached to a static component of the vacuum pump. The stator member can e.g. be attached to a pump housing of the vacuum pump or to the dividing wall. The attaching can comprise an adhesive bonding of the stator member with the static component.

BRIEF DESCRIPTION OF THE DRAWINGS

The invention will be described in the following by way of example with reference to advantageous embodiments and to the enclosed drawings. The drawings show.

DETAILED DESCRIPTION OF THE PREFERRED EMBODIMENT

Figure 1:
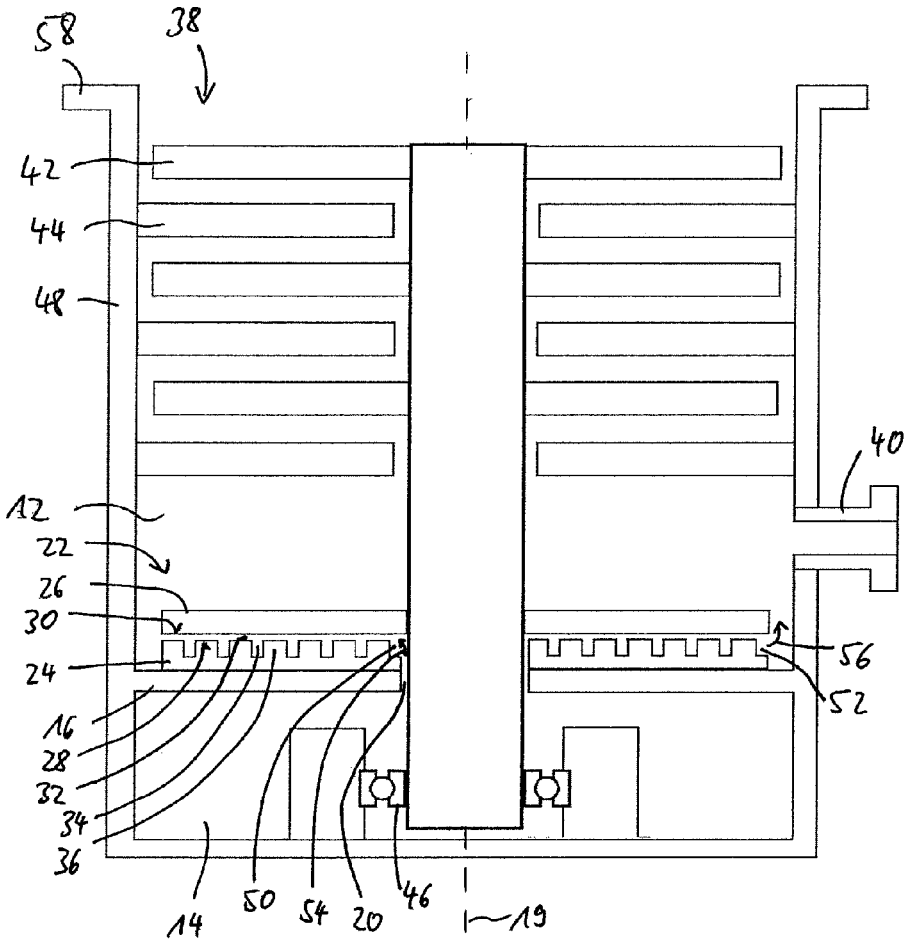
FIGS. 1 to 4 a cross-sectional view of, respectively, a vacuum pump in accordance with an embodiment of the invention.

The vacuum pump shown in FIG. 1 is configured as a turbomolecular pump and comprises a working space 12 and a bearing space 14, which are bounded by a pump housing 48 of the vacuum pump, a dividing wall 16 separating the working space 12 and the bearing space 14 from one another, and a rotor shaft 18 which extends through the dividing wall 16 into the working space 12 and into the bearing space 14 while forming a radial gap 20.

The turbomolecular pump structure is accommodated in the working space 12. This pump structure comprises a plurality of turbomolecular rotor disks 42 fastened to the rotor shaft 18 and comprises turbomolecular stator disks 44 arranged between the rotor disks 42 and fixed in the housing 48. The pump structure provides a pump action for a process gas which is applied at a pump inlet 38 which is bounded by an inlet flange 58 of the housing 48. This pump action serves to convey the process gas from the pump inlet 38 to the pump outlet 40.

A roller element bearing 46 which supports the rotor shaft 18 rotatably about the axis of rotation 19 is arranged in the bearing space 14. In principle, a magnetic bearing or a magnetic bearing cartridge could also be provided in the bearing space 14 for the rotatable support of the rotor shaft 18. Furthermore, a drive, not shown in FIG. 1 for the rotor shaft 18 can be provided in the bearing space 14.

The vacuum pump comprises a Siegbahn pump stage 22 having a stator member 24 carried by the dividing wall 16 and a rotor member 26 carried by the rotor shaft 18. The stator member 24 and the rotor member 26 are each configured substantially in disk shape and are oriented radial to the direction of rotation of the axis of the rotor shaft 18.

The stator member 24 and the rotor member 26 each have one of two mutually oppositely disposed surfaces 28, 30 acting as pumps which form the structure acting as a pump of the Siegbahn pump stage 22. Whereas the surface 30 acting as a pump of the rotor member is formed by a planar surface which is oriented perpendicular to the axis of rotation 19 of the rotor shaft 18, the surface 28 acting as a pump of the stator member 24 is structured.

The surface 28 acting as a pump of the stator organ 24 comprises a depression which forms a conveying passage 34 of the Siegbahn pump stage 22, which extends spirally from internal to external in the radial direction, and an elevated portion 36 bounding the depression or the conveying passage 34. The surface region of the elevated portion 36 which faces toward the surface 30 acting as a pump of the rotor member 26 forms an axial sealing gap 32 with the surface 30 acting as a pump, said sealing gap sealing the conveying passage 34.

In the operation of the vacuum pump, the gas present in the conveying passage 34 is driven by the structure acting as a pump in the direction of rotation of the rotor shaft 18 and is thereby conveyed outwardly along the spiral line shape of the conveying passage 34 from the inlet 30 of the Siegbahn pump stage 22 facing the gap 20 in the radial direction to the outlet 52 of the Siegbahn pump stage 22 facing the working space 12. A pump action directed through the gap 20 from the bearing space 14 into the working space 12 is thereby provided which is illustrated by arrows 54 in FIG. 1 and which blocks the bearing space 14 from the working space 12.

The vacuum pumps shown in FIGS. 2 to 4 substantially correspond, with the exception of the special features described in the following, to the vacuum pump shown in FIG. 1, with the same reference numerals in FIGS. 1 to 4 each designating the same or mutually corresponding components.

Figure 2:
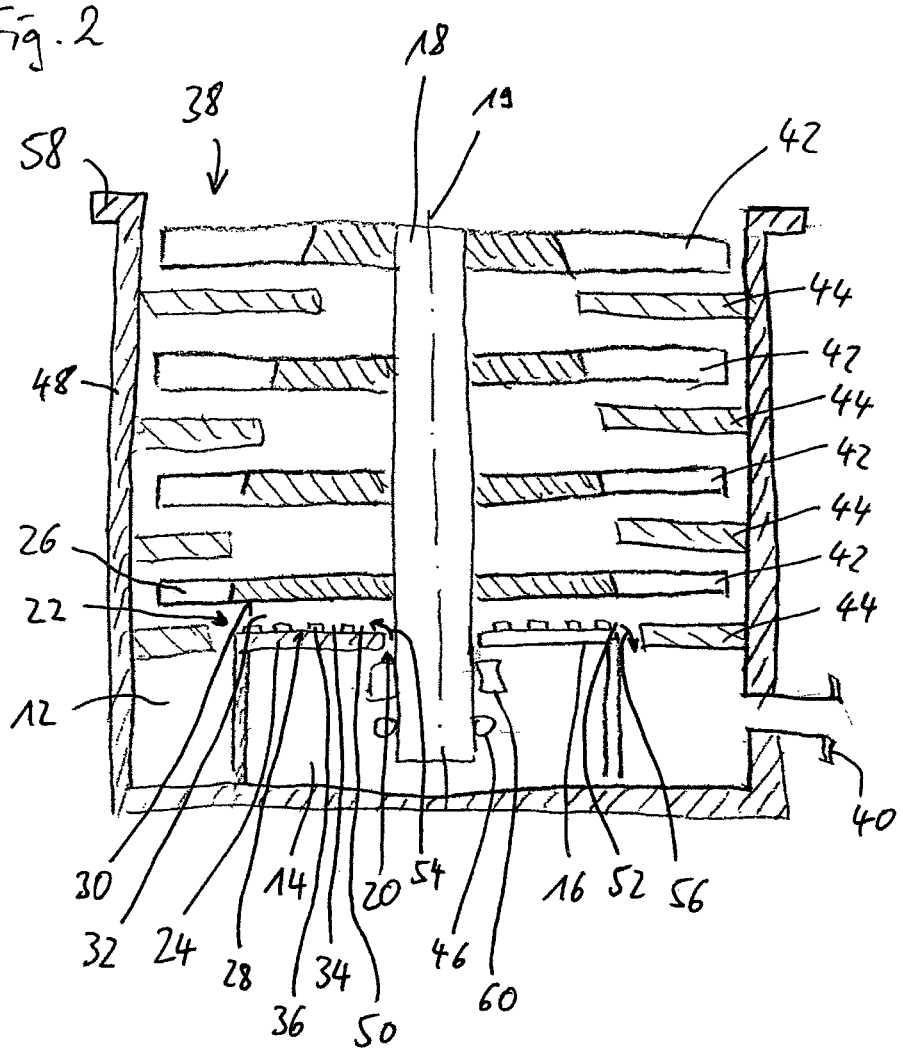

In the vacuum pump shown in FIG. 2, the rotor member 26 of the Siegbahn pump stage 22 and its surface 28 acting as a pump are formed by the last rotor disk 42 in the conveying direction. The section of the rotor disk 42 forming the surface 28 acting as a pump carries the vanes of the rotor disk 42 which extend outwardly in the radial direction starting from this section. The process gas is conveyed, following on from the last rotor disk 42, laterally past the bearing space 14 in the direction of the axis of rotation to the pump outlet 40.

The drive 60 arranged in the bearing space 14 is also shown schematically in FIG. 2.

Figure 3:
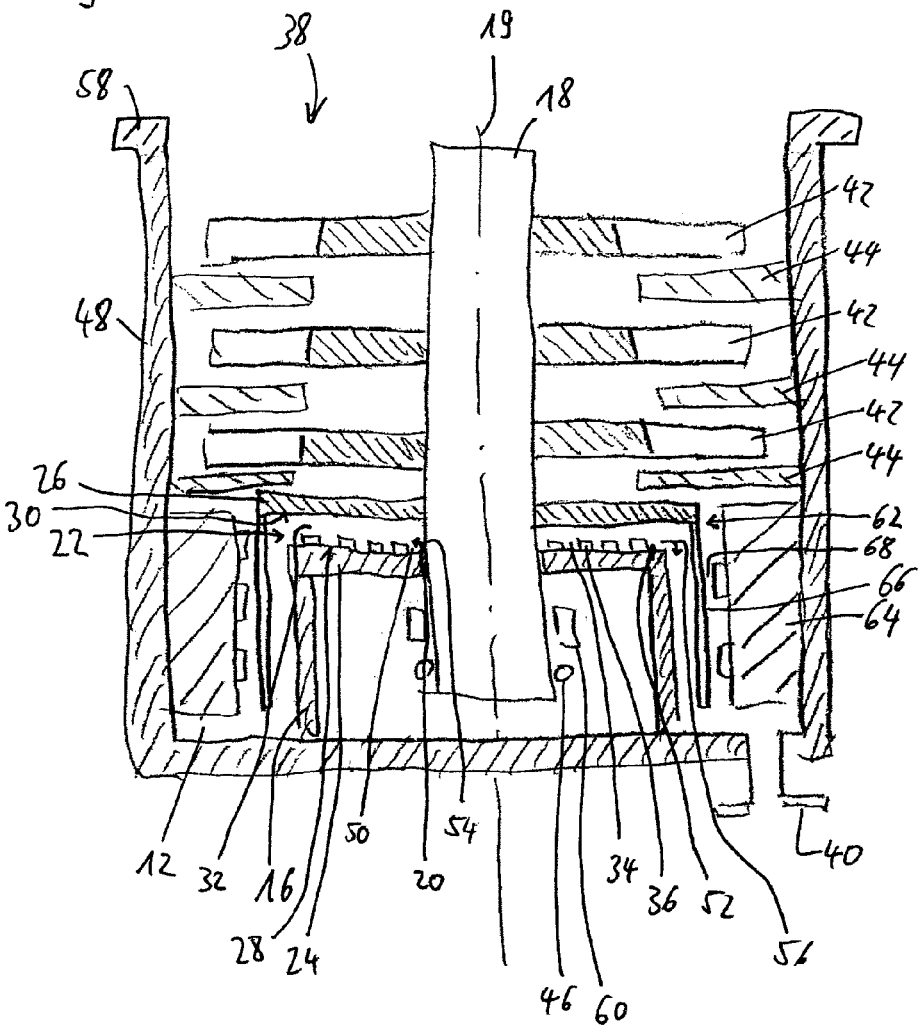

The vacuum pump shown in FIG. 3 substantially corresponds to the vacuum pump shown in FIG. 2, with a Holweck pump stage having a Holweck rotor 62 and a Holweck stator 64 being provided instead of the last turbomolecular pump stage in the direction of flow of the pump shown in FIG. 2, said Holweck pump stage conveying the gas conveyed by the turbomolecular pump stages further to the pump outlet 40. The rotor member 26 of the Siegbahn pump stage 22 and its surface 28 acting as a pump are formed in this embodiment by the rotor hub of the Holweck pump stage connected to the rotor shaft 18 or by a planar surface thereof which is of disk shape and which is oriented in the radial direction toward the axis of rotation 19.

The Holweck rotor 62 comprises a Holweck cylinder 66 carried by the rotor hub and having a smooth radial outer surface in the present embodiment which forms a surface acting as a pump of the Holweck pump stage and is disposed opposite a surface acting as a pump of the Holweck stator 64 formed by the radial inner surface of the sleeve-shaped Holweck stator 64 while forming a narrow radial Holweck gap 68. The surface acting as a pump of the Holweck stator 64 is structured and forms one or more conveying passages which extend spirally about the axis of rotation 19 in the axial direction. In the operation of the vacuum pump, the process gas conveyed by the turbomolecular pump stages to the inlet of the Holweck pump stage in conveyed in the conveying passages of the Holweck pump stage and through them to the pump outlet 40.

The vacuum pump shown in FIG. 4 substantially corresponds, except for the special features described in the following, to the vacuum pump shown in FIG. 3.

Figure 4:
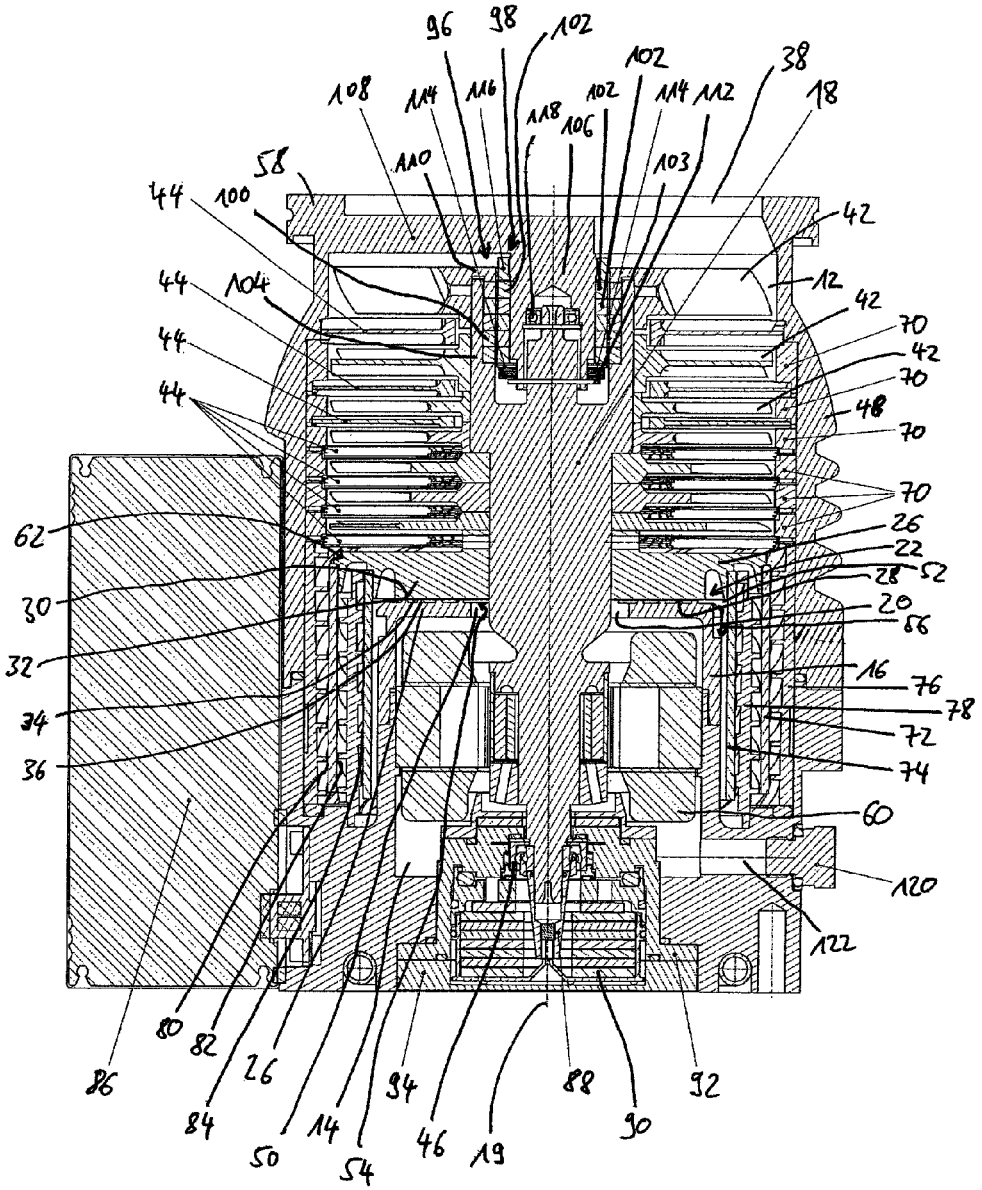

The vacuum pump shown in FIG. 4 comprises a larger number of turbomolecular pump stages each having a rotor disk 42 and a stator disk 44, with the stator disks 44 being held by spacer rings 70 at a predefined spacing from one another. The vacuum pump furthermore comprises three Holweck pump stages which follow one another in the radial direction nested in one another, which are connected to the turbomolecular pump stages and to one another in series in the direction of flow and which are each formed in the manner described above with respect to the Holweck pump stage shown in FIG. 2.

The Holweck pump stages comprise a Holweck rotor 62 having an outer Holweck cylinder 72 and an inner Holweck cylinder 74 which are each carried by a common rotor hub which simultaneously forms the rotor member 26 and the surface 28 acting as a pump of the Siegbahn pump stage 22. The Holweck pump stages furthermore comprise an outer Holweck stator 76 and an inner Holweck stator 78 which are each formed in sleeve shape. The radial inner surface of the outer Holweck stator 76 forms a first Holweck pump stage having a Holweck gap 80 with the radial outer surface of the outer Holweck cylinder 72; the radial inner surface of the outer Holweck cylinder 72 forms a second Holweck pump stage having a Holweck gap 82 with the radial outer surface of the inner Holweck stator 78; and the radial inner surface of the inner Holweck stator 78 forms a third Holweck pump stage having a Holweck gap 84 with the radial outer surface of the inner Holweck pump stage 74.

The vacuum pump shown in FIG. 4 comprises a drive 60 which is configured as an electric motor and which is brushless DC motor in the present embodiment. An electronic control unit 86 serves for the control and current feed of the drive 60.

A conical splash nut 58 having an outer cross-section reducing toward the roller element bearing 46 is provided at the end of the rotor shaft 18 at the bearing space side. The splash nut 88 is in sliding contact with at least one wiper of an operating medium store which comprises a plurality of absorbent disks 90 which are stacked on one another and which are saturated with an operating medium for the roller element bearing 46, e.g. with a lubricant for the roller element bearing 46. In the operation of the vacuum pump, the operating medium is transferred from the operating medium store via the wiper through the capillary action onto the rotating splash nut 88 and is conveyed as a result of the centrifugal force in the direction of the outer diameter of the splash nut 88 increasing in size to the roller element bearing 46, where it satisfies its desired function. The roller element bearing 46 and the operating medium store are encompassed by a tub-shaped insert 92 and by a cover element 94 of the vacuum pump.

The rotor shaft 18 is rotatably supported by a magnetic bearing, which is configured as a permanent magnetic bearing in the present embodiment, at the high vacuum side, i.e. in the region of the pump inlet 38. The magnetic bearing comprises a bearing half 96 at the rotor side and a bearing half 98 at the stator side which each comprise a ring stack of a plurality of permanently magnetic rings 100 and 102 respectively stacked on one another in the axial direction. The magnetic rings 100, 102 are disposed opposite one another while forming a narrow radial bearing gap 103, with the magnetic rings 100 at the rotor side being arranged radially outwardly and the magnetic rings 102 at the stator side being arranged radially inwardly. The magnetic field present in the bearing gap 103 effects magnetic repulsion forces between the rings 100, 102 which effect a radial support of the rotor shaft 18.

The magnetic rings 100 at the rotor side are carried by a carrier section 104 of the rotor shaft 18, the carrier section surrounding the magnetic rings 100 at the radially outer side. The magnetic rings 102 at the stator side are carried by a carrier section 106 at the stator side which extends through the magnetic rings 102 and is suspended at radial struts 108 of the housing 48. The magnetic rings 100 at the rotor side are fixed in parallel with the axis of rotation 19 in the one direction by a cover element 110 coupled to the carrier section 104 and in the other direction by a shoulder section of the carrier section 104. The magnetic rings 102 at the stator side are fixed in parallel with the axis of rotation in the one direction by a fastening ring 112 connected to the carrier section 106 and by a compensation element 114 arranged between the fastening ring 112 and the magnetic rings 102 and are fixed in the other direction by a support ring 116 connected to the carrier section 106.

An emergency bearing or safety bearing 118 is arranged within the magnetic bearing; it idles in the normal operation of the vacuum pump without contact and only moves into engagement on an excessive radial deflection of the rotor relative to the stator to form a radial abutment for the rotor shaft 18 which prevents a collision of the structures at the rotor side with the structures at the stator side. The safety bearing 118 is configured as a non-lubricated roller element bearing and forms a radial gap with the rotor and/or the stator, said gap having the effect that the safety bearing 118 is out of engagement in normal pump operation. The radial deflection at which the safety bearing 118 comes into engagement is dimensioned sufficiently large that the safety bearing 118 does not move into engagement in the normal operation of the vacuum pump and is simultaneously small enough that a collision of the structures at the rotor side with the structures at the stator side is avoided under all circumstances.

The vacuum pump shown in FIG. 4 comprises a barrier gas inlet 122 which is closed by a closure element 120, which connects the bearing space 14 to the pump exterior and via which a barrier gas can be supplied to the bearing space 14. The barrier gas supplied to the bearing space 14 is conveyed via the Siegbahn pump stage 22 into the working space 12 in the operation of the vacuum pump, whereby the bearing space 14 is blocked with respect to the working space 12.

What is claimed is:

1. A vacuum pump, comprising:

a working space (12), a bearing space (14), a dividing wall (16) arranged between the working space (12) and the bearing space (14), a blocking device for blocking between the working space (12) and the bearing space (14), at least one rotor shaft (18) extending through the dividing wall (16), and a bearing for rotationally supporting the at least one rotor shaft located in the bearing space (14), and a gap (20) between the at least one rotor shaft (18) and the dividing wall (16), wherein the blocking device is formed by a Siegbahn pump stage (22), the Siegbahn pump stage being configured to provide a pump action between the working space (12) and the bearing space (14), with the pumping action directed through the gap (20) to block the bearing space (14) from the working space (12), wherein the Siegbahn pump stage (22) comprises a stator member (24) and a rotor member (26), wherein the stator member (24) and the rotor member (26) each forms one of two mutually oppositely disposed surfaces (28, 30) acting as pumps of the Siegbahn pump stage (22), and a rotor hub of a Holweck pump stage which simultaneously forms the rotor member (26) of the Siegbahn pump stage (22).

2. The vacuum pump in accordance with claim 1, wherein the pump is one of a turbomolecular pump and a side-channel pump.

3. The vacuum pump in accordance with claim 1:

wherein one surface (28) of the two mutually oppositely disposed surfaces (28, 30) acting as a pump is formed by a structured surface and another surface (30) of the two mutually oppositely disposed surfaces (28, 30) acting as a pump is formed by a planar surface.

4. The vacuum pump in accordance with claim 3, wherein the stator member (24) has the structured surface (28) acting as a pump.

5. The vacuum pump in accordance with claim 1:

wherein the two mutually oppositely disposed surfaces (28, 30) acting as pumps bound at least one conveying passage (34) of the Siegbahn pump stage (22) and a sealing gap (32) for sealing the conveying passage (34).

6. The vacuum pump in accordance with claim 5, wherein a region of at least one surface (28, 30) of the two mutually oppositely disposed surfaces (28, 30) acting as a pump which bounds the sealing gap (32) is or can be produced at least by a material-removing machining.

7. The vacuum pump in accordance with claim 1, wherein at least one of the stator member (24) and the rotor member (26) is configured as substantially disk-shaped.

8. The vacuum pump in accordance with claim 1, wherein at least one of the stator member (24) and the rotor member (26) is configured as one of an injection molded part, a forged part and a shaped part.

9. The vacuum pump in accordance with claim 1, wherein at least one of the stator member (24) and the rotor member (26) at least partly or fully comprises a metal.

10. The vacuum pump in accordance with claim 9, wherein the metal is aluminum.

11. The vacuum pump in accordance with claim 1, wherein at least one of the stator member (24) and the rotor member (26) at least partly or fully comprises a plastic.

12. The vacuum pump in accordance with claim 1, wherein the stator member (24) is configured as a separate part which is carried by a static component (16, 48) of the vacuum pump.

* * * * *